United States Patent [19]

Rapp et al.

[11] 4,454,392

[45] Jun. 12, 1984

[54] SAFETY SWITCH

[76] Inventors: Werner Rapp, Südmährerstrasse 26, D-7340 Geislingen; Peter Schmidt, Libanonstrasse 75, D-7000 Stuttgart 1, both of Fed. Rep. of Germany

[21] Appl. No.: 435,375

[22] Filed: Oct. 20, 1982

[51] Int. Cl.[3] ..... H01H 27/00

[52] U.S. Cl. ..... 200/61.67; 200/44; 200/324; 200/334

[58] Field of Search ..... 200/44, 42 R, 153 T, 200/61.67, 61.7, 322, 324, 334, 61.61

[56] References Cited

U.S. PATENT DOCUMENTS

| | | | |
|---|---|---|---|
| 3,793,492 | 2/1974 | Duncan et al. | 200/47 |
| 3,840,715 | 10/1974 | Gwozdz | 200/61.7 |
| 4,066,856 | 1/1978 | Merkle | 200/44 |
| 4,395,608 | 7/1983 | Eicker et al. | 200/153 L |

*Primary Examiner*—John W. Shepperd
*Assistant Examiner*—Renee S. Kidorf
*Attorney, Agent, or Firm*—Wigman & Cohen

[57] ABSTRACT

A safety switch comprising a drive and locking device. A key is used to operate the drive. The drive comprises a ram longitudinally moved by the key. The locking device includes a blocking member for the ram which can only be released by the key.

22 Claims, 7 Drawing Figures

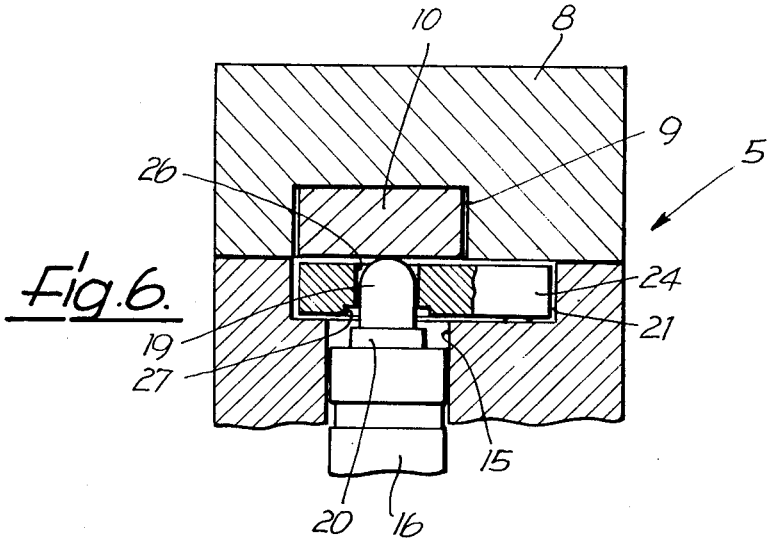
Fig. 6.
Fig. 7.
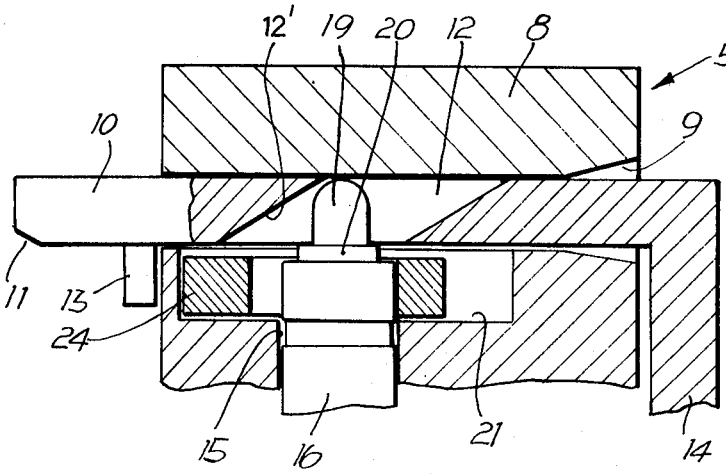

SAFETY SWITCH

BACKGROUND OF THE INVENTION

The invention relates to a safety switch.

In removing a housing or housing element of an apparatus or machine, or even for example in opening a cover or a door, it can be necessary for safety reasons to trigger a switch in an electrical circuit, particularly to interrupt and keep it interrupted as long as the door or cover is open or the housing is removed. In some such cases it is necessary to provide a forced activation of the safety switch so that the switching is assured even when the switch is damaged, for example when its contact points are welded together.

One known safety switch of the above-described type is capable of causing a forced switching, because its key, which is attached for example on the removable housing element or the door, forcibly rotates a cam disc both as it enters into the housing containing the drive and locking device and as it is pulled out thereof. The rotation of this cam disc is transformed into a forced translational movement of the switch drive member by means of a connecting rod eccentrically hinged to the cam disc. The switch drive member is connected with the other end of the connecting rod. Disadvantages of this known safety switch, however, are that the cam disc of the drive and locking device is expensive and is subject to failure because of unavoidable wear, that the connecting rod, which can have only a relatively small cross section for spacial reasons, can break when the contact points of the switch are welded together and that the disc can be rotated thereby triggering a switching step not only with the key, a projection of which engages in a notch in the outer surface of the disc, but also with a simple tool, such as a screwdriver. The latter is a significant disadvantage, since, for example, with machines, it is repeatedly attempted to operate the machine for adjustment or control purposes, when the protective hood or the like is removed, which should not be permitted for safety reasons. Furthermore, this known safety switch is neither moisture proof nor dustproof.

In West German publication DE-OS No. 2128322 there is described an electrical switch activated by a ram in which the activating force is transferred to the ram by an elastic activating lever. However, in a safety switch the activating force should not be transferred by an elastic member. For this reason alone this previously known design for a safety switch is contrary to accepted practice. The activating lever, formed of an elastic material and provided with a central longitudinal slot extending from one end nearly to the other end, can be located in various positions on the switch housing. For this reason the open-slot end section is attached to the side of the housing from which the ram extends. This attachment is accomplished with the aid of two pairs of screws, between which the free end section of the activating lever is introduced until it reaches a position in which the screws engage in notches in the activating lever. In order to activate the ram, a force must be exerted on the activating lever acting in the direction of movement of the ram. This force elastically deforms the activating lever to such an extent that the closed end section thereof comes into contact with the ram and activates same. The activating lever thus does not activate the ram of the switch as one of its ends is introduced between the screws in the manner of a key. This is another reason that this activating lever cannot be used as a key for a safety switch.

OBJECTS AND SUMMARY OF THE INVENTION

The object of the invention is to create a safety switch which not only forcibly switches as the key enters or exits, particularly being opened thereby, but which also has a construction which is as simple and strong as possible and requires no maintenance. Additionally, the switch of the present invention is not susceptible to misuse, i.e., cannot be activated without the proper use of the key.

These objects are achieved with a safety switch having the characteristics of claim 1. The ram, which transforms the movements of the key relative to the housing directly into the forcible switch activation movement, is a particularly simple structural element which is not susceptible to failure and requires no maintenance. In addition, the latch associated with the ram guarantees that the switch cannot be improperly activated with the use of any common tool. Furthermore, because of the simple construction of the drive and locking device, the safety switch can be readily made moisture and dustproof.

The ram and the actual switch activating member, which acts directly on the support of the movable contact element or on the movable contact element itself, can be constructed in one piece. However, in order to use a common commercial switch, it is desirable to provide a separate ram. This ram can transfer its motion to the switch activation member by means of one or more intermediate members. A preferred embodiment which offers the simplist, space-saving and strong construction of the safety switch according to the invention, occurs when the ram is arranged coaxially to the longitudinally slideable switch activating member. For a forcible opening of the switch, i.e., while forming a positive engagement, the ram can then press directly on the activating member and forcibly move it.

In order to allow the ram to be directly activated by the key and also avoid intermediate members, the longitudinal axis of the ram preferably lies at an acute angle or a right angle to the longitudinal extension of the guide path for the key. As it moves along this guide path the key can then push out the end of the ram projecting into the guide path and thereby transfer its longitudinal motion into a longitudinal movement of the ram. Preferably, a similar movement transfer also takes place as the key exits the housing where the key has an inclined surface formed by the wall of an inclined bore through the key. Such bore has a sufficiently large diameter to permit the ram to penetrate therein. The ened of the ram projecting into the guide path thus comes into abutment with this inclined surface. With regard to manufacturing expense, this type of inclined bore is generally more desirable than an inclined surface formed in some other manner.

The blocker, which prevents a movement of the ram with means other than the key, is preferably formed by a disc which is rotatably mounted in the housing and is rotated about its rotational axis by means of a carrier of the key. This disc is locked in its two end positions by the ram. The security against an improper activation is particularly great with this arrangement, for at first the key must move the ram by an amount insufficient for a switching before it releases the disc, which is a requirement for a rotation thereof by means of the key. This, in turn, is a requirement for the key to be able to move the ram far enough that a forced switching of the switch is achieved.

In a preferred embodiment of the safety switch according to the invention, the rotational axis of this disc lies parallel to the longitudinal axis of the ram, for then the disc can include an opening for the entry of the ram at least in its two end positions, where the ram projects into the guide path of the key. It is also possible, however, to select another position for the rotational axis of the disc relative to the longitudinal axis of the ram.

As a result of this securing of the ram against an improper movement, achieved by the rotatable disc, the shape of which will generally deviate from the circular, a simple, inexpensive and strong embodiment of the key is possible.

The transfer of the key movement to the switch by means of the ram is also of particular advantage, in that it thus becomes possible without additional expense, to rotate the housing containing the drive and locking device relative to the housing containing the contact points about the longitudinal axis of the ram or an axis parallel thereto and thus be able to connect it with the housing containing the contact points in different rotational positions. The switch according to the invention can be easily adapted to various installation conditions.

BRIEF DESCRIPTION OF THE DRAWINGS

The invention is described in greater detail below with the aid of an exemplary embodiment which is illustrated in the drawings wherein:

FIG. 6 is a partial sectional view of the exemplary embodiment with the key partially inserted into the housing; and FIG. 7 is a partial sectional view of the exemplary embodiment with the key completely inserted.

DESCRIPTION OF THE PREFERRED EMBODIMENT

A safety switch, by means of which an electrical current can be forcibly interrupted when two elements which are movable relative to each other, are separated from each other, such as through the opening of a door or removal of a cover of a machine, has a block-like lower housing portion 1. Bores 2 are provided to receive screws for attachment to one of the two elements that are movable relative to each other, as for example on a door frame or on the non-removable portion of a protective housing. The lower housing portion 1 contains a common commercial switch 3 of the feeler pin type construction having a longitudinally movable, rod-like activating member 4, the longitudinal axis of which is perpendicular to the limit surface 6 of the lower housing portion which serves as a contact surface for a head designated generally as 5. An opening in the limit surface 6 permits access to the activating member 4 for activation purposes.

Figure 1:
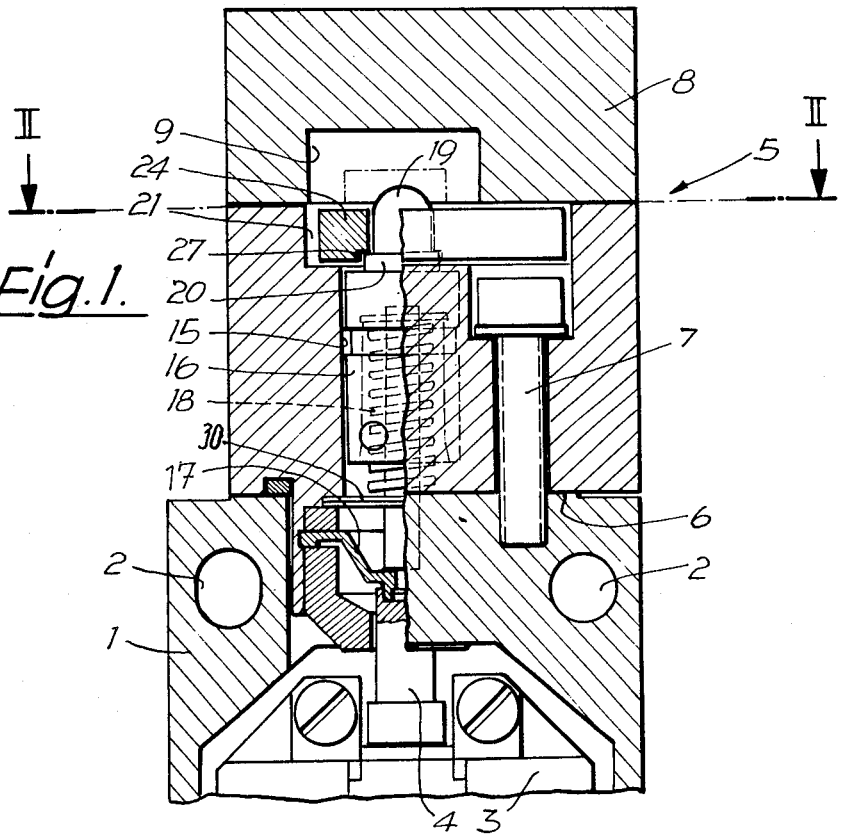
FIG. 1 is a partial longitudinal sectional view of an exemplary embodiment of the present invention without the key.

The block-like head 5, may be firmly but detachably connected to the lower housing portion 1 by screws 7 with a sealing element arranged therebetween and which can be placed on the lower housing portion 1 in four different positions rotated by 90° about the longitudinal axis of the activating member 4 for adaptation to the circumstances of installation. Head 5 includes a two-part housing 8, which contains a drive and locking device as well as a guide path 9 for a key designated generally with 10. The guide path 9 lies, as shown in FIG. 1, in the portion of the housing 8 separated from the lower housing portion 1, passes completely through this portion 8 and has a rectangular cross section. The cross-sectional shape of the guide path 9 is thereby adapted to that of the key 10. Sufficient play for the key 10 in the guide path 9 assures the necessary easy accessability of the key 10.

Figure 5:
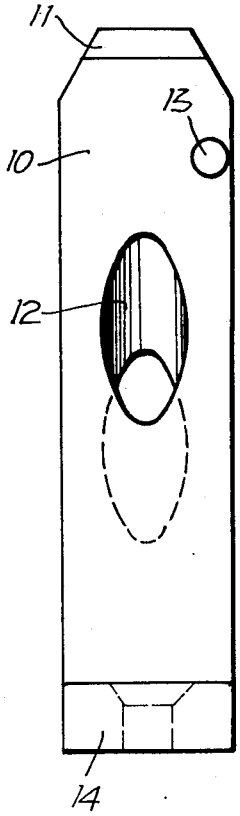
FIG. 5 is a top view of the side of the key facing the ram.

The key 10 includes an inclined surface 11 on its free end on the side facing the lower housing portion 1 as it is introduced. Furthermore, it is provided with a completely penetrating inclined bore 12, the longitudinal axis of which is inclined such that the portion of the bore wall lying next to the free end of the key is open toward the lower housing portion 1 when the key is in the guide path 9. A carrier pin 13 projects past this side, (toward the lower housing portion). As shown in FIG. 5, pin 13 is arranged on the lateral edge zone of the key 10 near to the narrowing free end thereof. On the other end of the key 10 is joined an attachment shank 14, which in the exemplary embodiment, is formed of one piece. This attachment shank 14, which could also have a different shape or position with reference to the actual key, is attached to the removable housing or housing portion or, for example, to a door.

A guide bore 15 penetrates the head 5 from its surface against the lower housing portion 1 to the guide path 9 and the longitudinal axis of which is aligned with the longitudinal axis of the activating member 4 and lies perpendicular to the longitudinal axis of the guide path 9. Bore 15 receives ram 16, which is longitudinally slidable therein. One end of ram 16 abuts one side of a diaphram 17. The free end of the activating member 4 abuts the diaphram 17 at its opposite side, as shown in FIG. 1. The diaphram 17 seals the lower housing portion 1 toward the head 5. A helical compression spring 18 supported on one side against an annular disc 30 and on the other side against the ram 16 biases the ram toward a position in which its other end section 19, which forms an arch, projects into the guide path 9. This end section 19 forms an annular zone with a smaller diameter than the center section of the ram 16 and adjoins a narrow annular zone 20, the diameter of which is greater than that of the annular zone formed by the end section 19, but smaller than that of the center section. An annular groove in the center section serves for the application of lubricating grease.

Figure 2:
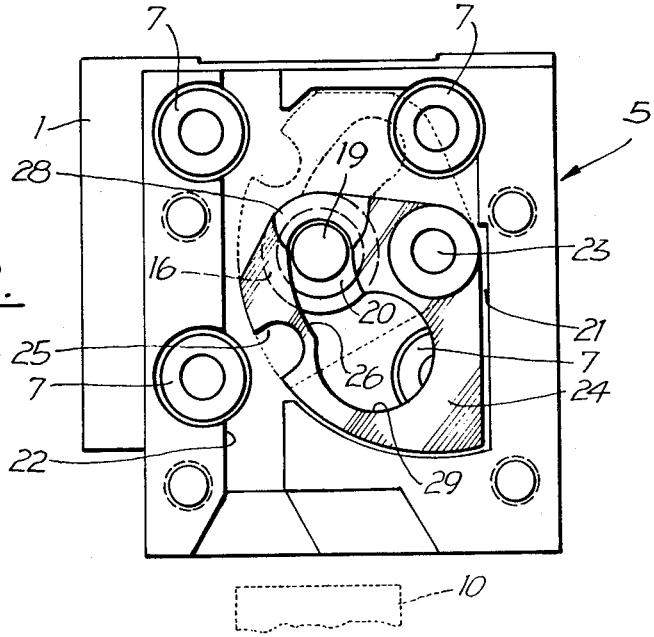
FIG. 2 is a sectional view taken along the line II—II of FIG. 1.
Figure 3:
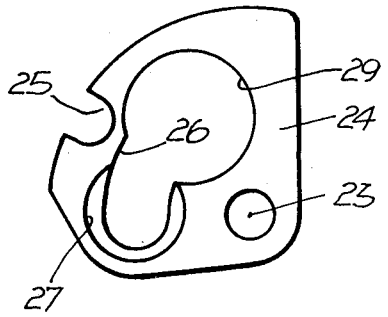
FIG. 3 is a sectional view taken from below the disc which is illustrated in top view of FIG. 2.
Figure 4:
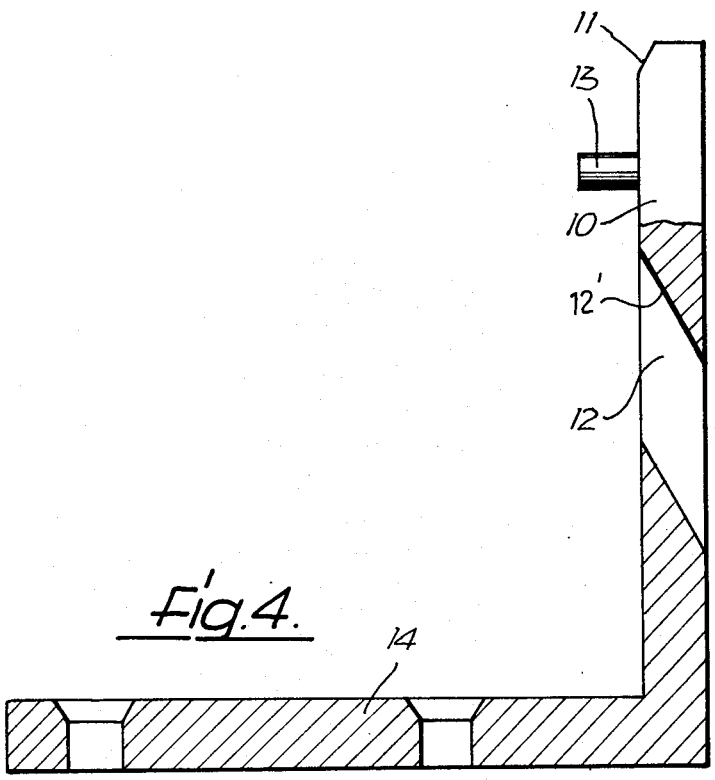
FIG. 4 is a longitudinal sectional view through the key.

The guide path 9 is open in the direction of the lower housing portion 1 to a depression 21 in the portion of the housing 8 containing the guide bore 15. As shown in FIG. 2, the depression 21 forms a penetrating channel 22 extending parallel to the guide path 9, said channel 22 having an entry funnel on its end serving for the introduction of the key 10. This channel 22 serves to receive the carrier pin 13. In the lateral portion of the depression 21 lying next to the channel 22, into which the guide bore 15 opens, lies a blocking disc 24 which is pivotable about an axis 23 and whose exterior shape is similar to a circular segment of about 90°. The axis 23 lies parallel to the longitudinal axis of the ram 16 and penetrates the blocking disc 24 in the vicinity of the point of the circular segment. In the outer edge zone which projects into the channel 21 the blocking disc 24 has an outwardly open, groove-like notch 25, in which the carrier pin 13 engages.

Between the notch 25 and the rotational axis 13 the blocking disc 24 has an opening 26 in the form of a slot extending along a circular arc about the axis 23. As shown in FIG. 2, beginning at about a halfway point of the slot up to the end thereof directed toward the ram 16, the width of the slot is larger than the diameter of the arch-forming end section 19 by an amount equal to the necessary play, when the key is completely removed from the guide channel 9.

Only on the underside of the blocking disc 24 facing the lower housing portion 1 is this end of the opening 26 provided with a spotfaced area 27, the diameter of which is determined in accordance with that of the annular zone 20, so that the latter can enter the spotfaced area 27, as shown in FIG. 1. The depth of the spotfaced area 27, is selected in such a manner that it is smaller than the penetration depth of the end section 19 into the guide channel 9. The spotfaced area 27 serves to prevent rotation of the blocking disc 24 by receiving the annular zone 20. Such a rotation in the clockwise direction, as viewed in FIG. 2, is only possible when the ram 16 has previously been shifted far enough toward the lower housing portion 1 that the annular zone 20 comes out of engagement with the spotfaced area 27. An inclined area 28 on the side of the blocking disc 24 facing the guide path 9 and extending the slot 26 prevents the use of a screwdriver or similar tool from first pressing the arch of the end section 19 of the ram 16 so far toward the lower housing portion 1 that the annular zone 20 releases the blocking disc 24 and the disc can then be rotated by means of this tool.

The inclined area 28 has a shape similar to a ramp and ascends from the end of the slot 26 to the edge of the disc 24. Thus, if a screwdriver or similar tool is inserted in the guide path 9 and used to push down end section 19 until the screwdriver touches the upper surface of the disc 24, there is no edge at the rear end of the slot 26 against which the free end of the screwdriver could be pressed. Rather, the free end of the screwdriver will instead be moved against the free area 28 and slide up over that ramp-shaped area. That results in the upward movement of the screwdriver and the release of end section 19 such that it moves upward to its original position.

The other end of the opening 26 is expanded to a penetrating bore 29, the diameter of which is determined by that of the center section of the ram 16, so that the latter can project through this bore sufficiently deep into the guide path 9 when the blocking disc 24 has been pivoted into the other end position by the key 10, as shown in FIG. 2 with broken lines. In this position the bore is directed toward the ram 16.

In this end position of the blocking disc 24, the inclined bore 12 of the key 10 is also directed toward the ram 16. The diameter of the inclined bore 12 is selected such that in this position the end section 19 of the ram 16 engages in the inclined bore 12. If the key 10 is then drawn out of the head 5 because the door or the cover connected with the key is opened or removed, the wall of the inclined bore 12 presses as an inclined surface 12' against the arch of the end section 19 and thereby transforms the longitudinal movement of the key 10 positively into a longitudinal movement of the ram 16 toward the activating member 4. The latter is thereby forcibly pushed into the position corresponding to the open position of the switch 3. The switch 3 is therefore also opened when it is damaged, for example if a spring is broken or its contact points have been welded together. In the latter case, the contact points are broken apart. By means of this forcible longitudinal movement of the ram 16, the ram arrives in a position where only the end section 19 projects into the opening 26. The key 10 can therefore now also pivot the blocking disc 24 into the other end position with the aid of the carrier pin 13.

As the key 10 is introduced into the guide path 9, first the free end of the key presses the ram 16 far enough out of the guide path 9 for the annular zone 20 to release the blocking disc 24. Then the carrier pin 13 carries the blocking disc 24 and pivots it into the position in which the end of the opening 26 is expanded to a bore and the inclined bore 12 are directed toward the ram 16.

Although only a preferred embodiment is specifically illustrated and described herein, it will be appreciated that many modifications and variations of the present invention are possible in light of the above teachings and within the purview of the appended claims without departing from the spirit and intended scope of the invention.

What is claimed is:

1. In a safety switch having a drive and locking device, which has a longitudinally movable drive member which forcibly switches the switch at least in one direction, a housing containing the drive and locking device and a key which can be formfittingly coupled with the drive and locking device and can be introduced into the housing, the movement of which key relative to the housing during introduction or removal from the drive and locking device is transformed into a forcible switching of the switch, the improvement wherein the drive member comprises a ram which can be actuated longitudinally directly by means of a key which touches said ram during actuation thereof, said locking device including a blocking member for said ram which can only be released by said key.

2. The safety switch according to claim 1, wherein said housing can be rotated relative to a lower housing portion containing the contact points of said switch about the longitudinal axis of said ram or an axis parallel thereto and can be rigidly connected with the lower housing portion containing the contact points of the switch in various rotational positions.

3. The safety switch according to claim 1, wherein said ram is arranged coaxially with respect to a longitudinally movable switch activating member.

4. The safety switch according to claim 3, wherein said housing can be rotated relative to a lower housing portion containing the contact points of said switch about the longitudinal axis of said ram or an axis parallel thereto and can be rigidly connected with the lower housing portion containing the contact points of the switch in various rotational positions.

5. The safety switch according to claim 1 wherein said blocking element is formed by a disc which is rotatably mounted in said housing and can be rotated by means of a carrier of said key about its rotational axis and said disc being locked in its two end positions by said ram.

6. The safety switch according to claim 5, wherein said housing can be rotated relative to a lower housing portion containing the contact points of said switch about the longitudinal axis of said ram or an axis parallel thereto and can be rigidly connected with the lower housing portion containing the contact points of the switch in various rotational positions.

7. The safety switch according to claim 5, wherein the rotational axis of said disc is parallel to the longitudinal axis of said ram and said disc has an opening for engaging said ram at least in its two end positions, where said ram projects into the guide path of said key.

8. The safety switch according to claim 7, wherein said housing can be rotated relative to a lower housing portion containing the contact points of said switch about the longitudinal axis of said ram or an axis parallel thereto and can be rigidly connected with the lower housing portion containing the contact points of the switch in various rotational positions.

9. The safety switch according to claim 7, wherein said disc opening has the shape of a slot extending along a circular path about the rotational axis of said disc having a spotfaced area and a penetrating bore in the vicinity of its two end sections and said ram has different diameters in the region which engages in the slot-like opening and consists of the end section and its adjoining annular zone whereby the diameter of the end section and that of the annular zone is adapted to the slot-like opening, its spotfaced area and its penetrating bore in such a manner that a rotation of said disc from one end position into the other is only possible when said ram is pushed out of the guide path by said key.

10. The safety switch according to claim 9, wherein said housing can be rotated relative to a lower housing portion containing the contact points of said switch about the longitudinal axis of said ram or an axis parallel thereto and can be rigidly connected with the lower housing portion containing the contact points of the switch in various rotational positions.

11. The safety switch according to claim 7, wherein said disc has a notch which is open toward the disc edge for engagement with the carrier of said key and the opening lies between this notch and the rotational axis of the opening.

12. The safety switch according to claim 11, wherein said housing can be rotated relative to a lower housing portion containing the contact points of said switch about the longitudinal axis of said ram or an axis parallel thereto and can be rigidly connected with the lower housing portion containing the contact points of the switch in various rotational positions.

13. In a safety switch having a drive and locking device, which has a longitudinally movable drive member which forcibly switches the switch at least in one direction, a housing containing the drive and locking device and a key which can be formfittingly coupled with the drive and locking device and can be introduced into the housing, the movement of which key relative to the housing during introduction or removal from the drive and locking device is transformed into a forcible switching of the switch, wherein the drive member comprises a ram which can be moved longitudinally by means of a key, said locking device including a blocking member for said ram which can only be released by said key, said ram is arranged coaxially with respect to a longitudinally movable switch activating member, the longitudinal axis of said ram lies in an acute or right angle to the longitudinal extension of a guide path for said key; and a spring acting on said ram for biasing said ram toward a position in which its end opposite the switch activating member projects into the guide path for said key.

14. The safety switch according to claim 13, wherein said blocking element is formed by a disc which is rotatably mounted in said housing and can be rotated by means of a carrier of said key about its rotational axis and said disc being locked in its two end positions by said ram.

15. The safety switch according to claim 13, wherein said housing can be rotated relative to a lower housing portion containing the contact points of said switch about the longitudinal axis of said ram or an axis parallel thereto and can be rigidly connected with the lower housing portion containing the contact points of the switch in various rotational positions.

16. The safety switch according to claim 13, wherein said ram and said key include cooperating inclined surfaces which transform a longitudinal movement of said key into a longitudinal movement of said ram.

17. The safety switch according to claim 16, wherein said blocking element is formed by a disc which is rotatably mounted in said housing and can be rotated by means of a carrier of said key about its rotational axis and said disc being locked in its two end positions by said ram.

18. The safety switch according to claim 16, wherein said housing can be rotated relative to a lower housing portion containing the contact points of said switch about the longitudinal axis of said ram or an axis parallel thereto and can be rigidly connected with the lower housing portion containing the contact points of the switch in various rotational positions.

19. The safety switch according to claim 16, wherein said key inclined surface is formed by the wall of an inclined bore which penetrates the key, said inclined bore having a diameter which permits the end section of the ram to enter.

20. The safety switch according to claim 19, wherein said blocking element is formed by a disc which is rotatably mounted in said housing and can be rotated by means of a carrier of said key about its rotational axis and said disc being locked in its two end positions by said ram.

21. The safety switch according to claim 19, wherein said housing can be rotated relative to a lower housing portion containing the contact points of said switch about the longitudinal axis of said ram or an axis parallel thereto and can be rigidly connected with the lower housing portion containing the contact points of the switch in various rotational positions.

22. In a safety switch having a drive and locking device, which has a longitudinally movable drive member which forcibly switches the switch at least in one direction, a housing containing the drive and locking device and a key which can be formfittingly coupled with the drive and locking device and can be introduced into the housing, the movement of which key relative to the housing during introduction or removal from the drive and locking device is transformed into a forcible switching of the switch, wherein the drive member comprises a ram which can be moved longitudinally by means of a key, said locking device including a blocking member for said ram which can only be released by said key, said ram is arranged coaxially with respect to a longitudinally movable switch activating member, and said blocking element is formed by a disc which is rotatably mounted in said housing and can be rotated by means of a carrier of said key about its rotational axis and said disc being locked in its two end positions by said ram.

* * * * *